US005975060A

United States Patent [19]

Stover et al.

[11] Patent Number: 5,975,060

[45] **Date of Patent: *Nov. 2, 1999**

[54] DEDICATED OVERHEAD CAM SHAFT FOR UNIT INJECTOR

[75] Inventors: Thomas R. Stover; Andrew P. Perr, both of Columbus, Ind.

[73] Assignee: Cummins Engine Company, Inc., Columbus, Ind.

[ * ] Notice: This patent is subject to a terminal disclaimer.

[21] Appl. No.: 09/008,808

[22] Filed: Jan. 20, 1998

[51] Int. Cl.[6] ..... F02M 37/04

[52] U.S. Cl. ..... 123/508; 123/90.27

[58] Field of Search ..... 123/90.27, 90.22, 123/509, 508, 507, 446, 90.23

[56] References Cited

U.S. PATENT DOCUMENTS

| | | | |
|---|---|---|---|
| 2,005,536 | 6/1935 | Dickson . | |
| 4,141,329 | 2/1979 | Pompei . | |
| 4,412,513 | 11/1983 | Obermayer et al. | 123/509 |
| 4,448,116 | 5/1984 | Amemori et al. | 123/90.27 |
| 4,448,166 | 5/1984 | Amenori | 123/90.27 |
| 4,615,323 | 10/1986 | LeBlanc et al. . | |
| 4,721,075 | 1/1988 | Kasai | 123/90.27 |
| 4,732,119 | 3/1988 | Melde-Tuczai et al. | 123/90.27 |
| 4,836,171 | 6/1989 | Melde-Tuczai et al. | 123/508 |
| 5,287,840 | 2/1994 | Catanu et al. | 123/508 |
| 5,315,974 | 5/1994 | Sabelstrom et al. . | |
| 5,421,298 | 6/1995 | Ming et al. | 123/90.27 |
| 5,427,073 | 6/1995 | Timms et al. . | |
| 5,495,838 | 3/1996 | Johnson, Jr. . | |
| 5,507,261 | 4/1996 | Johnson, Jr. | 123/508 |
| 5,520,155 | 5/1996 | Hefler | 123/509 |
| 5,564,395 | 10/1996 | Moser et al. . | |
| 5,622,143 | 4/1997 | Fuoss et al. | 123/90.27 |
| 5,651,337 | 7/1997 | Regueiro | 123/90.27 |
| 5,669,344 | 9/1997 | Reueiro | 123/90.27 |
| 5,806,499 | 9/1998 | Stover | 123/508 |

FOREIGN PATENT DOCUMENTS

| | | |
|---|---|---|
| 0 011 611 | 5/1980 | European Pat. Off. . |
| 0 664 392 A1 | 7/1995 | European Pat. Off. . |
| 40 26 499 C1 | 8/1991 | Germany . |
| 62-90973 | 6/1987 | Japan . |
| 62-97263 | 6/1987 | Japan . |

*Primary Examiner*—Carl S. Miller
*Attorney, Agent, or Firm*—Sixbey, Friedman, Leedom & Ferguson; Charles M. Leedom, Jr.; Tim L. Brackett

[57] ABSTRACT

The present invention provides an internal combustion engine drive train actuating assembly which includes a dual overhead cam shaft arrangement wherein a pair of cam shafts is supported in the head section of the engine. One cam shaft is positioned to actuate the intake and exhaust valves. The other cam shaft is dedicated to actuating only the unit fuel injectors and is positioned relative to the injector actuating rocker levers to contact only these rocker levers during engine operation. The rocker lever-contacting lobes on the dedicated injector-actuating cam shaft are dimensionally wider than has heretofore been possible, which allows the high fuel injection pressures required to achieve optimum fuel economy and emissions while minimizing hertz stresses on the cam shaft.

11 Claims, 3 Drawing Sheets

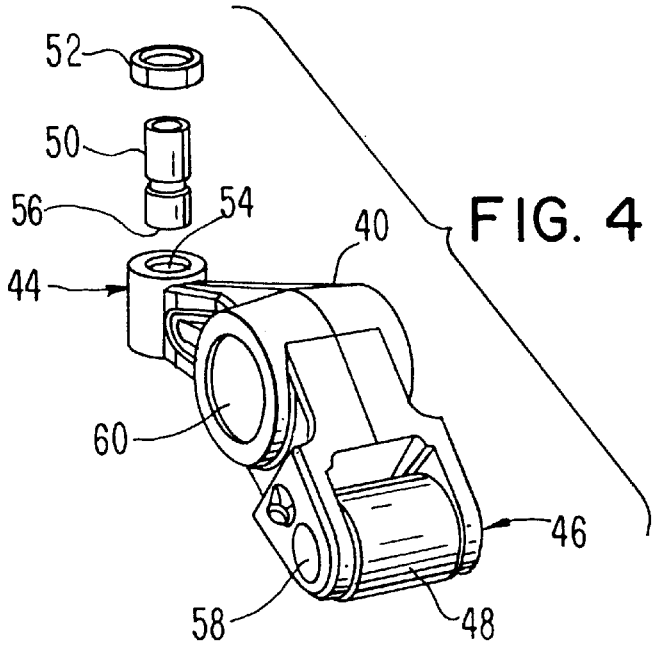
FIG. 4
FIG. 5
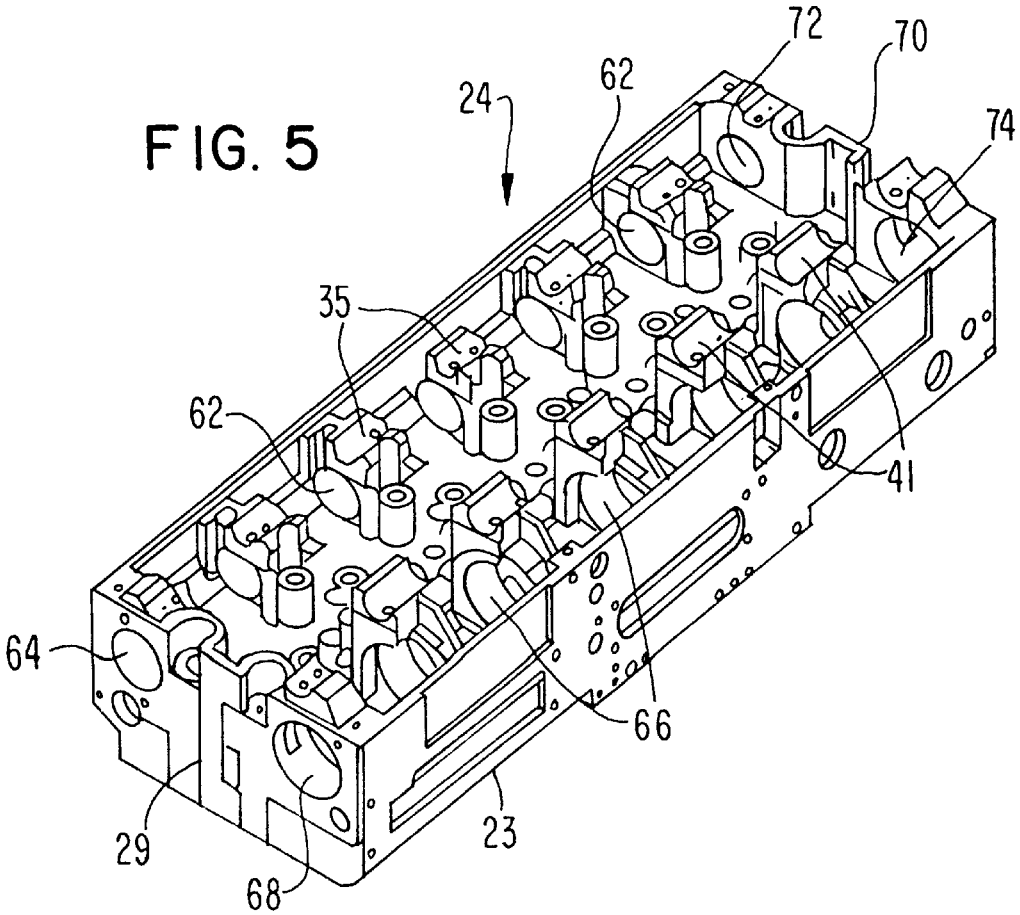

DEDICATED OVERHEAD CAM SHAFT FOR UNIT INJECTOR

TECHNICAL FIELD

The present invention relates generally to drive train actuation assemblies for internal combustion engines and specifically drive train actuation assembly with a dual overhead cam shaft arrangement wherein one cam shaft is dedicated to actuating only the unit injectors.

BACKGROUND OF THE INVENTION

The ever increasing demand for achieving and maintaining minimum exhaust emissions and fuel efficient internal combustion engines has required increasingly higher fuel injection pressures. These higher fuel injection pressures, particularly in unit injectors in diesel engines, increase the hertz stress on the injector-actuating cam shaft and its associated following mechanism. When the unit injectors and the intake and exhaust valves in a diesel engine are actuated by the same cam shaft, space constraints can severely limit the axial placement of the injector lobes since all of the valve-actuating lobes and the injector-actuating lobes must be located on the same cam shaft. When sufficient axial space is not available, the hertz stresses on the cam shaft can become unacceptably high. Unless hertz stresses on the cam shaft are kept to a reasonable level, injector pressures of a desirable magnitude cannot be achieved.

Cam-operated unit fuel injectors are known in the art. U.S. Pat. No. 5,315,974 to Sabelström et al, for example, discloses a diesel engine with a fuel injection system which employs a cam shaft positioned in the engine overhead for operating a unit fuel injector.

Dual overhead cam shaft arrangements are also known. Most dual overhead cam shaft arrangements include one cam shaft dedicated to actuating the intake valves and one cam shaft dedicated to actuating the exhaust valves. U.S. Pat. No. 4,836,171 to Melde-Tuczai et al is illustrative of an internal combustion engine which employs two overhead cam shafts. The dual cam shaft arrangement disclosed in this patent includes cams for separately mounted rocker arms actuating pump nozzles which, in turn, are operated by the two cam shafts. The first cam shaft actuates the pump associated with one cylinder, and the second cam shaft actuates the pump associated with the adjacent cylinder. It is not suggested that this arrangement could be used to actuate unit fuel injectors; rather, it is designed to permit the easy disassembly of a selected pump nozzle without disturbing the two cam shafts and all the remaining valve gear.

None of the art of which applicants are aware suggests dedicating one cam shaft in a dual overhead cam shaft or other cam shaft arrangement solely to the actuation of the engine unit fuel injectors.

The prior art, therefore, has failed to provide a drive train actuation assembly for an internal combustion engine with a dual overhead cam shaft arrangement wherein one of the cam shafts is dedicated solely to actuating the engine unit fuel injectors, thereby minimizing hertz stresses on the cam shaft and prolonging cam life.

SUMMARY OF THE INVENTION

It is a primary object of the present invention, therefore, to overcome the disadvantages of the prior art and to provide an internal combustion engine drive train actuation assembly with a pair of overhead cam shafts, wherein one of the cam shafts is dedicated solely to actuating the engine unit fuel injectors and the other cam shaft is dedicated to actuating the intake and exhaust valves.

It is another object of the present invention to provide an internal combustion engine unit fuel injector actuation assembly which produces sufficiently high injection pressures to achieve and maintain desired emissions levels and fuel economy without exceeding reasonable hertz stresses on the engine cam shaft.

It is a further object of the present invention to provide an overhead cam shaft with lobes only for actuating the unit injectors in an internal combustion engine parallel to an overhead cam shaft with actuating lobes only for the engine intake and exhaust valves.

It is yet another object of the present invention to provide a cam shaft supporting only actuating lobes for the unit injectors in an internal combustion engine, wherein the diameter and the width of the lobes are significantly larger than the diameter and width of injector actuating lobes located on a cam shaft that also supports valve-actuating lobes.

It is a further object of the present invention to provide a dedicated cam shaft for the unit fuel injectors in an internal combustion engine which provides sufficient axial space to achieve reasonable hertz stresses on the cam shaft and associated following mechanism.

The aforesaid objects are satisfied by providing an internal combustion engine drive train actuation assembly which includes an internal combustion engine with a head section in which is rotatably mounted a pair of substantially parallel cam shafts positioned to extend coaxially with a long dimension of the engine head above the engine cylinder block. One of the cam shafts supports a plurality of lobes, each lobe being positioned relative to a rocker lever assembly drivingly connected to a unit fuel injector associated with a cylinder to contact the rocker lever assembly and actuate the unit injector during engine operation. The second cam shaft also supports a plurality of lobes, and each lobe is positioned to contact a rocker arm drivingly connected to a pair of intake valves or a pair of exhaust valves. The critical dimensions of the lobes supported by the injector-actuating cam shaft are selected to minimize the hertz stresses on the injector-actuating cam shaft.

Other objects and advantages will be apparent from the following description, claims and drawings.

BRIEF DESCRIPTION OF THE DRAWINGS

FIG. 4 is a perspective view of a cam-operated injector rocker lever according to the present invention; and FIG. 5 is a perspective view of the head section of an internal combustion engine showing the locations of the mounting structures for the drive train actuation assembly of the present invention.

DESCRIPTION OF THE PREFERRED EMBODIMENTS

The unit fuel injector actuating assembly of the present invention fills the demand for higher engine fuel injection pressures while maintaining reasonable hertz stresses on the injector-actuating cam shaft and associated following mechanism. Higher injection pressures maximize fuel economy and minimize engine emissions. However, the higher hertz stresses associated with these higher injection pressures tends to decrease the durability of the engine. The present invention obviates this problem by permitting the desired higher injection pressures while maintaining reasonable hertz stresses, thus increasing engine life.

Figure 1:
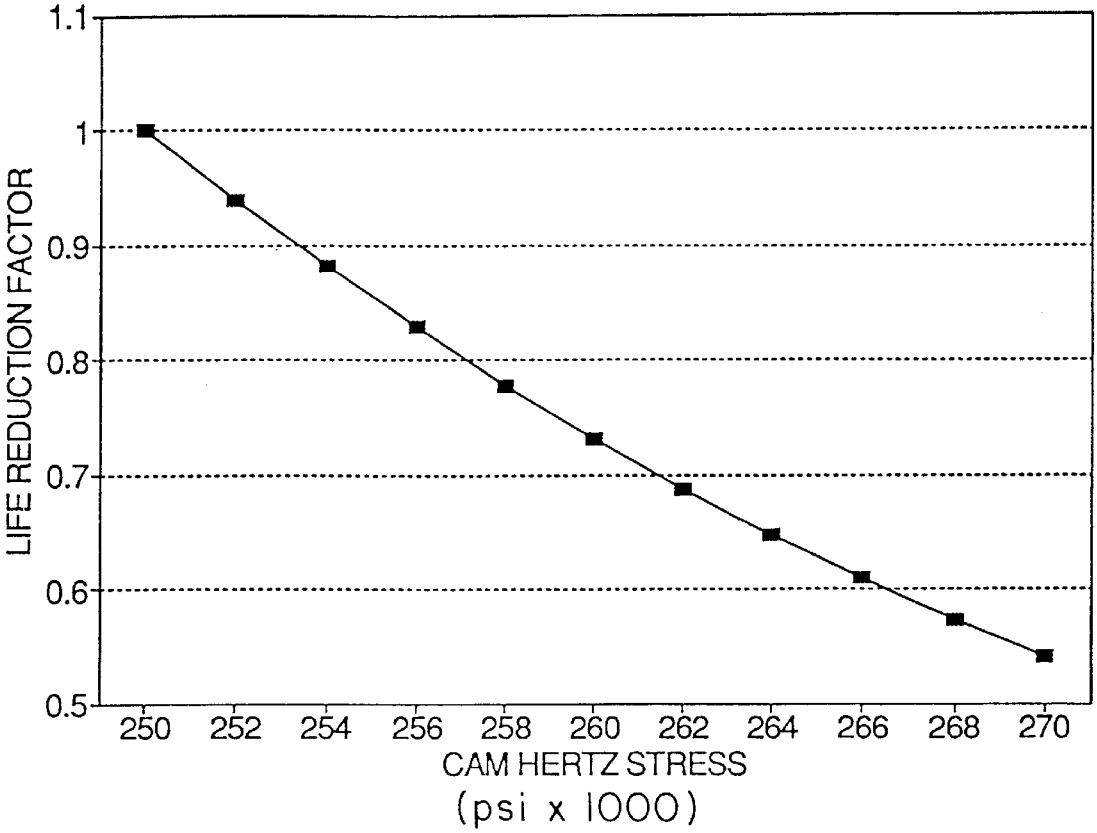
FIG. 1 represents, in graphic form, the relationship between cam life and hertz stress.

Hertz stress results from rolling contact stresses between the cam shaft and the rollers contacting the cam shaft lobes. Failures of these components are usually due to material fatigue. The maximum hertz stress that can be tolerated by an engine cam shaft is generally about 250,000 psi. FIG. 1 is a graphic representation of the relationship between cam life and hertz stress. This graph demonstrates the fundamental relationship between hertzian stress and cam life for a classic fatigue spell. The relationship shown in FIG. 1 can be expressed simplistically as follows:

$$\text{Life} \propto \frac{1}{\text{stress}^8}.$$

There are, however, other factors which may affect cam life, such as, for example, the lubricating oil film, the presence of debris and the quality of the material used for the cam shaft and lobes.

Figure 2:
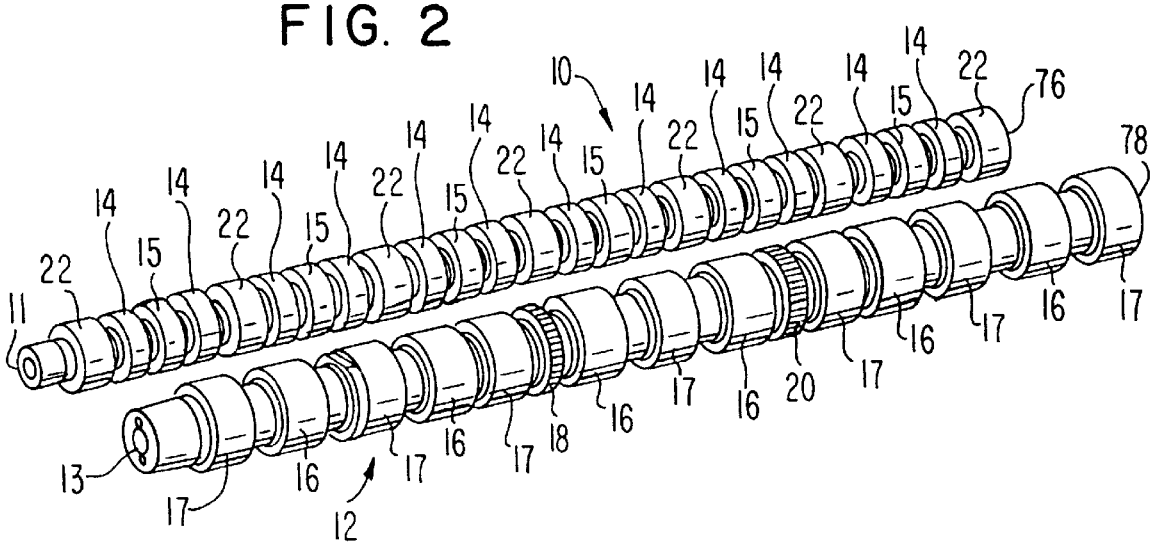
FIG. 2 is a perspective view of the dual overhead cam shaft arrangement of the present invention isolated from the internal combustion engine unit fuel injector actuation assembly.

The dual cam shaft arrangement of the present invention wherein one cam shaft is dedicated to actuating only the unit fuel injectors prolongs cam life because wider, larger lobes, which distribute the load over a greater area than is possible with a single cam shaft, can be provided. FIG. 2 illustrates the dual cam shafts of the present invention. Cam shaft 10 actuates the engine valves, and cam shaft 12 actuates the unit fuel injectors. The valve-actuating lobes 14 on the valve-actuating cam shaft 10 are narrower than the injector-actuating lobes 16 on the injector-actuating cam shaft 12. Each engine cylinder typically has two to four valves, but only one fuel injector, associated with it. Therefore, the number of lobes required to actuate the valves will be greater than the number of lobes required to actuate the injectors. The width of an injector lobe on a single cam shaft arrangement which actuates both valves and injectors is typically about 23 to 25 mm. In contrast, an injector lobe 16 on the dedicated injector cam shaft in the dual overhead cam shaft arrangement proposed by the present invention can be about 45 to 50 mm wide. A cam lobe with such a width dimension can maintain reasonable hertz stresses on the cam shaft, while allowing the injection pressures produced by the unit injectors to reach greater levels than is possible when the injectors and the valves are actuated by lobes mounted on the same cam shaft. The larger, wider lobes 16 distribute the load over a larger area than is possible with the narrower cam lobes than have been used to actuate unit injectors in prior art cam shafts.

The valve-actuating cam shaft 10 has bearing journals 22 spaced axially along the cam shaft 10 that are wider than the lobes 14 and 15. One bearing journal 22 is spaced between each set of three lobes along cam shaft 10. The valve lobes 14 actuate respective intake or exhaust valves, and the center brake lobe 15 activates the engine retarder (not shown). The injector-actuating cam shaft 12 of the present invention may include mounted thereon one or more tone wheels, such as tone wheels 18 and 20 shown in FIG. 2. The tone wheels are present to allow electronic measurement of the timing of the rotation of the cam shaft, which affects injection timing. The injector-actuating cam shaft 12 includes bearing journals 17. A bearing journal 17 is mounted between each injector lobe 16. The spacing of the injector lobes 16 and the bearing journals 17 is not symmetric, but is offset as required to accommodate the tone wheels 18 and 20. The bearing journals 17 and 22 support the cam shafts 10 and 12 in the cylinder head. Both cam shafts are mounted for rotation in the engine cylinder head as will be described below in connection with FIGS. 3, 4 and 5.

Figure 3:
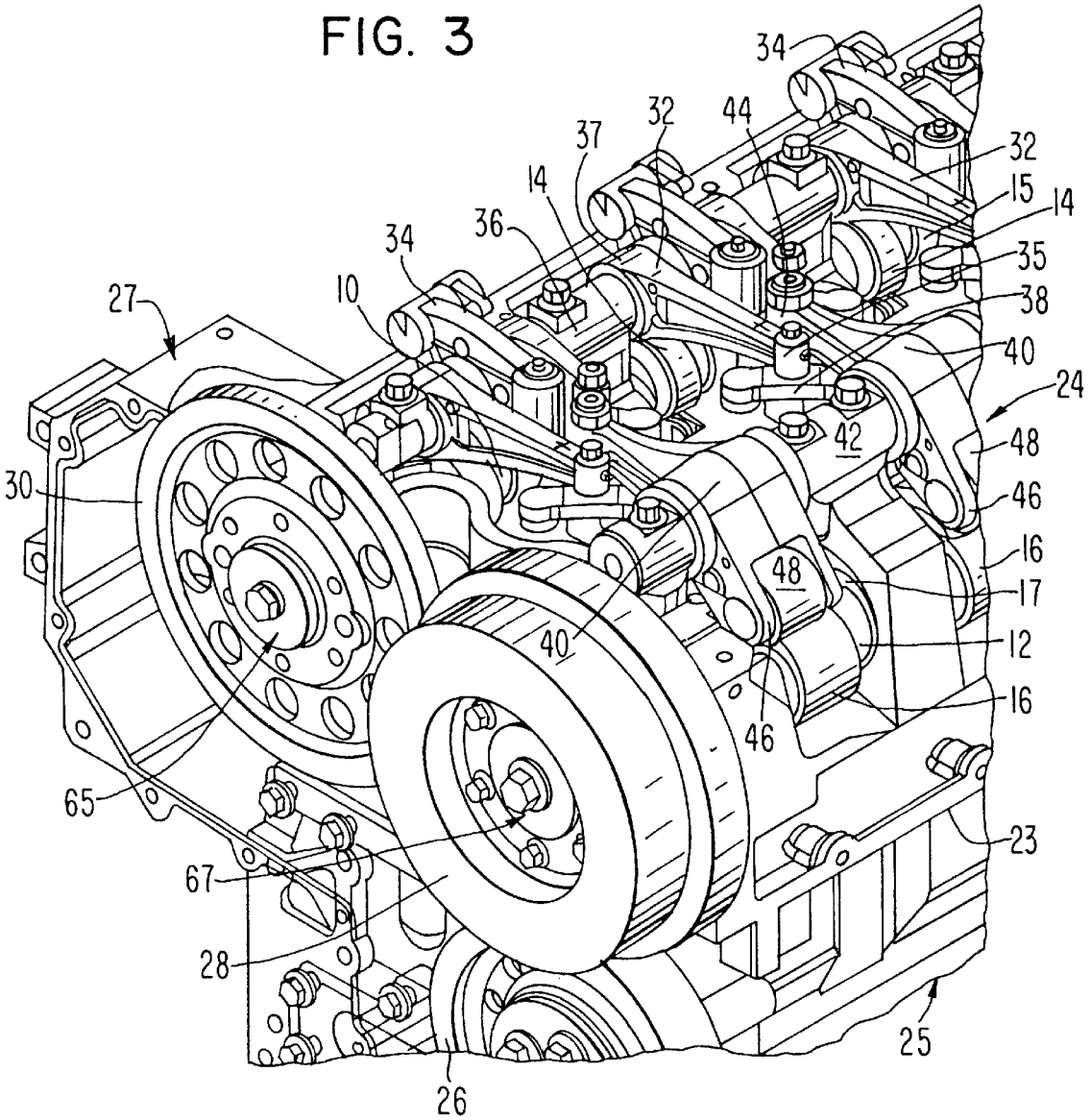
FIG. 3 is a perspective view of the drive train actuation assembly of the present invention mounted in the head section of an internal combustion engine.

FIG. 3 is a perspective view from one end of an engine with the cylinder head 24 mounted in place on the engine cylinder block 25. The actuating components for the engine drive train can be seen from this view. The gear wheel 26 is drivingly engaged by a gear wheel (not shown) mounted on the cylinder block 25 which rotates with the crank shaft (not shown) and drives gear wheel 28, which causes the dedicated injector cam shaft 12 to rotate. The gear wheel 28 is drivingly connected to gear wheel 30 so that as gear wheel 28 rotates, gear wheel 30 also rotates. The rotation of gear wheel 30 causes the valve-actuating cam shaft 10 to rotate. The gear wheels 26, 28 and 30 are normally covered by a gear cover assembly 27, only part of which is shown, during engine operation. The front panel of the cover assembly 27 has been removed to show the relative positions of the gear wheels.

The drive train actuation assembly of the present invention includes valve actuating rocker arms 32 that are pivotally mounted on a shaft 36 supported by shaft supports 35 (FIG. 5) mounted in the head 24. The configuration of rocker arm 32 enables the rocker arm to accommodate the valve cross heads secured to one end of each rocker arm so that the cross heads are positioned to contact a corresponding pair of intake or exhaust valves (not shown). Valve cross head 38 is shown secured to one end 35 of the rocker arm 32. Each valve cross head is connected to either at least one pair of intake valves or at least one pair of exhaust valves. The end 37 of rocker arm 32 opposite end 35 is configured to receive the shaft 36 and to contact a lobe 14 of the valve-actuating cam shaft 10 as the cam shaft 10 rotates during engine operation. As the cam shaft 10 rotates, the lobe 14 contacts the rocker arm 32, causing it to pivot about shaft 36 to open and close the valves (not shown) contacted by valve cross head 38. The rocker arms 32, which are not valve-activating rocker arms, but part of the engine retarder or brake system (not shown) are actuated by the brake lobes 15.

The injector-actuating cam shaft 12 is rotatably mounted to contact the injector rocker levers 40, which are shown in detail in FIG. 4. The injector rocker levers 40 are pivotally mounted on a shaft 42 (FIG. 3), which is supported on shaft mounts 41 (FIG. 5). One end 44 of the injector rocker lever 40 is drivingly connected to a unit fuel injector (not shown). The opposite end 46 is configured to rotatably mount a cam-contacting roller 48 which contacts one of the lobes 16 on the injector-actuating cam shaft 12 as the cam shaft rotates during engine operation to actuate the fuel injector.

FIG. 4 illustrates an injector rocker lever 40 which has a configuration that is preferred for use in the drive train actuation assembly of the present invention. Other configurations which function to provide a driving contact between the injector-actuating cam shaft 12 and a unit injector could also be employed. The rocker lever 40 shown in FIG. 4 has an injector contact end 44 which uses suitable connector elements, such as hex screw 50 and nut 52 to provide a driving connection between the rocker lever and the unit injector. The connector elements 50 and 52 are received in a substantially vertical bore 54 in the end 44 of the rocker lever 40 so that the terminal end 56 of the hex screw 50 (or like structure) directly contacts one or more unit injector actuating elements (not shown) ultimately causing fuel to be injected from the injector into the cylinder. The opposite end 46 of rocker lever 40 is configured to receive and mount a roller 48. The roller 48 is preferably mounted on a pin 58; however, other suitable mounting structure for the roller could also be used. The roller 48 contacts a lobe 16 of the injector-actuating cam shaft as the cam shaft rotates, which causes the rocker lever 40 to pivot about shaft 42, which in turn causes the terminal end 56 of the connector elements to contact the fuel injector actuating element. The rocker lever 40 has a shaft receiving bore 60 intermediate the ends 44 and 46 through which the shaft 42 passes to pivotally mount the rocker lever 40 in place on the shaft mounts 41.

FIG. 5 illustrates a perspective view of the head section 24 with the cam shafts 10 and 12, the rocker arm and rocker lever support shafts 36 and 42, the rocker arms 32 and 34, the rocker levers 40 and the valve cross heads shown in FIG. 3 removed. The respective shaft mounts 35 and 41 for the valve rocker arm supporting shaft 36 and the injector rocker lever supporting shaft 42 can be seen in FIG. 5. The head contacting portion of each of the shaft mounts 35 and 41 is configured with a cam shaft receiving bore to position each of the cam shafts 10 and 12 substantially parallel to each other and to support the cam shafts for rotational movement in a location between the rocker arms and rocker levers and the engine block contacting portion 23 of the head 24. Bores 62 are positioned in each shaft mount 35 to receive and support the bearing journals 22 on the valve-actuating cam shaft 10. A bore 64 is provided in the gear supporting end 29 of the head section 24 so that the drive end 11 of the cam shaft 10 can be connected by suitable structure, such as the assembly 65 shown in FIG. 3, to the gear wheel 30, thus allowing the cam shaft 10 to rotate when the gear wheel 30 is driven to rotate. Likewise, the configuration of mounts 41 includes bores 66 which receive and support the bearing journals 17 on the injector-actuating cam shaft 12. A bore 68 in the gear supporting end 29 of the head section 24 allows the drive end 13 of the injector-actuating cam shaft 12 to be connected by suitable structure, such as the assembly 67 shown in FIG. 3, to the gear wheel 28, which allows the cam shaft 12 to rotate when the gear wheel 28 is driven to rotate. The end 70 of the head section 24 is provided with bores 72 and 74 which receive the respective terminal ends 76 and 78 of the valve-actuating cam shaft 10 and the injector-actuating cam shaft 12. The ends 76 and 78 are rotatably supported in the bores 72 and 74 in the cylinder head by respective adjacent bearing journals 22 and 17. Each bearing journal 22 and 17 contacts an associated bushing and bearing (not shown) mounted in a respective bore 72 or 74 in a manner which permits the rotation of the shafts 10 and 12 required during engine operation.

INDUSTRIAL APPLICABILITY

The internal combustion engine drive train actuating assembly of the present invention will find its primary applicability in internal combustion engines, especially diesel engines, in which it is desired to optimize fuel efficiency while minimizing emissions and prolonging the life of cam shafts and other drive train components.

We claim:

1. An injector-actuating cam shaft for an internal combustion engine drive train actuation assembly mounted in a head section and positioned above a cylinder block section containing a plurality of high pressure unit fuel injectors and a plurality of intake and exhaust valves, wherein said injector-actuating cam shaft is mounted in said head section substantially parallel to a second, valve-actuating cam shaft, said injector-actuating cam shaft including a plurality of axially spaced lobes, each said lobe being positioned and sized to contact only injector-actuating structure associated with a unit fuel injector during engine operation.

2. The injector-actuating cam shaft described in claim 1 wherein the configuration of said injector-actuating cam shaft maintains hertz stress on the cam shaft below about 250,000 psi.

3. The injector-actuating cam shaft described in claim 2, wherein said injector-actuating cam shaft has a configuration comprising a plurality of injector-actuating structure-contacting lobes positioned axially along a shaft spaced alternately with a plurality of bearing journals along said shaft.

4. The injector-actuating cam shaft described in claim 3, wherein said injector-actuating cam shaft further includes at least one rotation timing measurement means for measuring the timing of the rotation of the injector-actuating cam shaft disposed between an injector-actuating structure-contacting lobe and a bearing journal.

5. The injector-actuating cam shaft described in claim 4, wherein the alternate spacing of the lobes and bearing journals along the shaft is asymmetrically offset to include said rotation timing measurement means.

6. The injector-actuating cam shaft described in claim 5, wherein each of the injector-actuating structure-contacting lobes has a width in range of about 45 to 50 mm.

7. The injector-actuating cam shaft described in claim 3, wherein said injector-actuating structure comprises a plurality of rocker levers, each said rocker lever having a pin-mounted roller that directly contacts a lobe on said shaft.

8. A cam shaft for rotational mounting in the head section of an internal combustion engine to actuate only the engine unit fuel injectors configured to contact directly a plurality of rocker levers, each rocker lever directly operatively contacting a unit fuel injector, wherein said cam shaft comprises a longitudinal shaft supporting at least one rotation timing measurement device and a plurality of alternating rocker lever-contacting cam lobes and bearing journals spaced axially and asymmetrically relative to the rotation timing measurement device along the shaft, wherein the configuration of said lobes is selected to maintain hertz stress below about 250,000 psi, thereby maximizing the useful life of said lobes.

9. The cam shaft described in claim 8, wherein said lobes have a width in the range of about 45 to 50 mm.

10. The cam shaft described in claim 9, wherein said shaft supports two rotation measurement devices and each measurement device is positioned between a lobe and an adjacent bearing journal so that the spacing of the lobes and bearing journals along the shaft is asymmetrically offset to include said rotation measurement devices.

11. The cam shaft described in claim 8, wherein said cam shaft is mounted in said head section substantially parallel to a second cam shaft dedicated to actuating only intake and exhaust valves in said engine.

* * * * *

UNITED STATES PATENT AND TRADEMARK OFFICE

CERTIFICATE OF CORRECTION

PATENT NO. : 5,975,060
DATED : November 2, 1999
INVENTOR(S) : Thomas R. Stover and Andrew P. Perr It is certified that error appears in the above-identified patent and that said Letters Patent is hereby corrected as shown below:

Title page,
Please insert the following:
-- This is a divisional of Serial No. 08/820,230, Filed March 18, 1997 which is now issued as Patent No. 5,806,499 --.

Column 1,
Line 1, please insert the following :
-- This is a divisional of Serial No. 08/820,230, Filed March 18, 1997, which is now issued as Patent No. 5,806,499 --.

Signed and Sealed this

Second Day of October, 2001

*Attest:*

Nicholas P. Godici

NICHOLAS P. GODICI
*Acting Director of the United States Patent and Trademark Office*

*Attesting Officer*